United States Patent [19]

Tarumi et al.

[11] Patent Number: 4,531,827

[45] Date of Patent: Jul. 30, 1985

[54] METHOD AND APPARATUS FOR IMPROVED RETENTION COPYING

[75] Inventors: Noriyoshi Tarumi, Hachioji; Kiyoshi Kimura, Iruma; Haruo Iwahashi, Fussa, all of Japan

[73] Assignee: Konishiroku Photo Industry Co., Ltd., Hino, Japan

[21] Appl. No.: 528,995

[22] Filed: Sep. 2, 1983

Related U.S. Application Data

[63] Continuation of Ser. No. 308,610, Oct. 5, 1981, abandoned.

[30] Foreign Application Priority Data

Oct. 16, 1980 [JP] Japan ..... 55-143645

[51] Int. Cl.[3] ..... G03G 15/00

[52] U.S. Cl. ..... 355/14 R; 355/3 R

[58] Field of Search ..... 355/3 R, 3 CH, 14 R, 355/3 DD, 14 D; 324/72; 430/54, 35, 31; 118/712

[56] References Cited

U.S. PATENT DOCUMENTS

| | | | |
|---|---|---|---|
| 3,788,739 | 1/1974 | Coriale | 355/14 R X |
| 3,852,668 | 12/1974 | Hardenbrook et al. | 324/72 X |
| 4,261,660 | 4/1981 | Suzuki et al. | 355/14 R |
| 4,284,344 | 8/1981 | Okamoto et al. | 355/14 CH X |

*Primary Examiner*—A. C. Prescott

*Attorney, Agent, or Firm*—Jordan B. Bierman

[57] ABSTRACT

A method of producing multiple copies of an original document with a minimum number of document imaging scannings includes impressing an electrostatic image of a reference density patch on the charge receptor together with an image of the document, detecting the potential of the patch, comparing the detected potential with a reference level, and controlling further copy production in accordance with the results of such comparison, so that additional copies are produced from the electrostatic image of the document without reimaging until the detected potential of the patch image drops below the reference level, at which time the patch and document are reimaged to form new electrostatic images of the patch and document on the charge receptor for the production of additional copies.

4 Claims, 6 Drawing Figures

METHOD AND APPARATUS FOR IMPROVED RETENTION COPYING

This application is a continuation of application Ser. No. 308,610, filed Oct. 5, 1981 now abandoned.

BACKGROUND OF THE INVENTION

1. Field of the Invention

The present invention relates to electrostatic reproducing apparatus.

2. Description of the Prior Art

A known electrostatic reproducing apparatus includes a charge receptor on which an electrostatic latent image is formed in accordance with the imaging signal of an image to be recorded. In this apparatus, after the latent image has been developed into a visible image, the latent image is not extinguished but is preserved on the charge receptor to permit only the visible image to be transferred to a sheet of recording paper; this step may then be repeated to form a plurality of reproduced images, or copies, with a single electrostatic image. Such apparatus is generally referred to as a "retention type electrostatic reproducing apparatus". One apparatus of this type incorporates a transfer belt to which the developed visible image on the charge receptor is transferred, the visible image then being further transferred to the recording paper and fixed thereon.

This retention type electrostatic reproducing apparatus, however, has the following disadvantage. The surface potential of the electrostatic latent image is gradually attenuated as the number of copies therefrom increases, as shown in FIG. 1. (Note: FIG. 1 shows the characteristics with parameters of optical density (O.D.), the illustrated optical density values of 0 and 1.3 being shown by way of example only.) As a consequence, the density of the reproduced image gradually decreases as shown in FIG. 2. This phenomenon is attributable to the following:

(1) As a copying operation is repeated, the electrostatic charge of the latent image gradually leaks through the body of the charge receptor.

(2) The electrostatic charge is neutralized by the charge produced by friction between the toner and the charge receptor. In addition, the electrostatic charge of the charge receptor leaks through the toner.

(3) In an apparatus having a transfer belt, the electrostatic charge of the latent image is negated by charges produced as the belt separates from the charge receptor.

As a consequence, the number of copies obtainable from a single electrostatic latent image is impractically limited. This problem is inherent in retention type electrostatic reproducing apparatus, and occurs in each of the operative steps including formation of the electrostatic latent image, development, transfer and fixing.

SUMMARY OF THE INVENTION

Accordingly, it is an object of the invention to provide a retention type electrostatic reproducing apparatus in which an electrostatic latent image of a predetermined reference density pattern (referred to hereinafter as a "patch") is formed on the charge receptor, and the surface potential of the electrostatic latent image of the patch is detected at the time of production of each copy. When the detected surface potential of the patch drops below a predetermined level, the document is reimaged to form a new electrostatic latent image thereof on the charge receptor.

Other objects and advantageous features of the invention will become clear from the following description of preferred embodiments in conjunction with the accompanying drawings.

DESCRIPTION OF THE PREFERRED EMBODIMENTS

Figure 1:
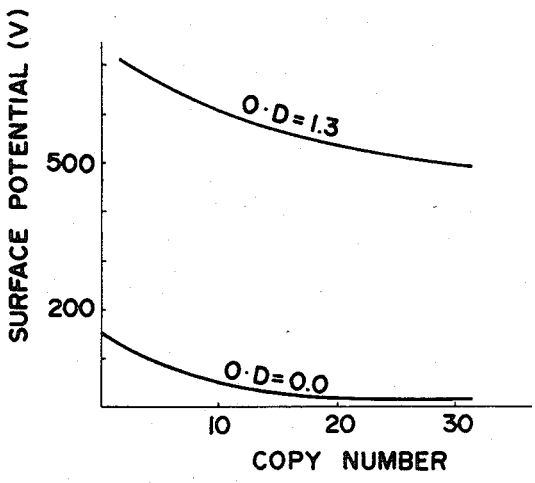
FIG. 1 is a graphical representation of the relationship between the number of copies produced and the reduction in surface potential of the electrostatic latent image.
Figure 2:
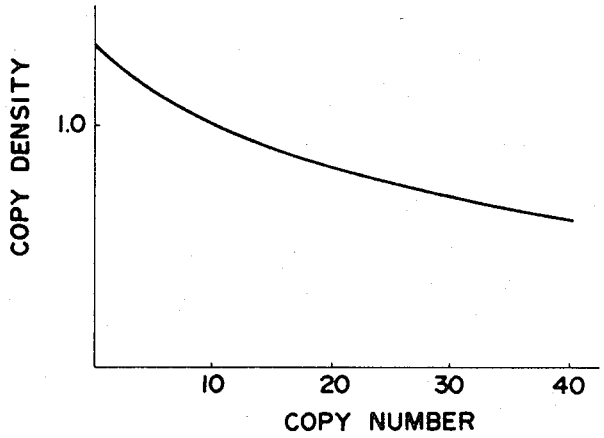
FIG. 2 is a graphical representation of the relationship between the number of copies produced and the density of the resulting copies.
Figure 3:
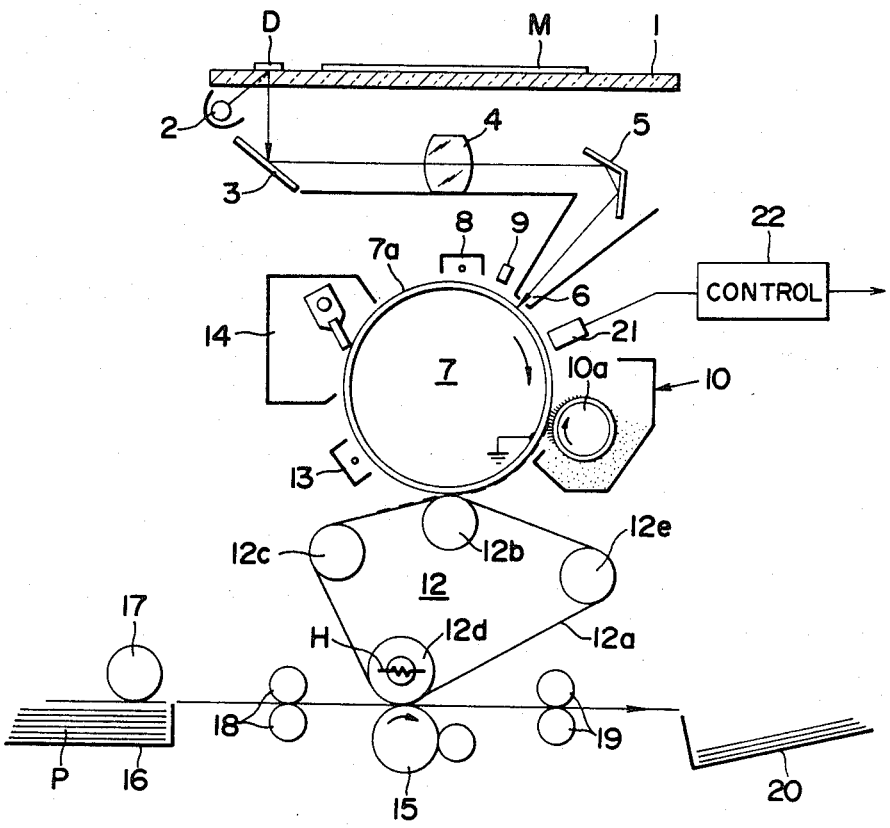
FIG. 3 is a schematic arrangement of a retention type electrostatic reproducing apparatus operable in accordance with the invention.

FIG. 3 schematically shows an embodiment of an electrostatic reproducing apparatus operable in accordance with the present invention. The illustrated embodiment is a belt transfer type apparatus making use of a photoconductive element as the charge receptor.

Reference numeral 1 designates a reciprocatable document glass plate for supporting a document M to be copied. A reference density pattern—reflected from imaged patch D—of optical density 1.3 is provided ahead or upstream of the region for supporting document M. Patch D preferably has a square form sized, for example, at 3 cm long and 3 cm wide. Reference numeral 2 designates an imaging lamp for illuminating document M. The light reflected from document M is reflected by a first mirror 3 and passes through a lens 4. The light is further reflected by a second mirror 5 and is projected, through an exposure slit 6, onto a photosensitive member 7*a* on a rotary drum 7. Serially arranged around rotary drum 7 are a charge generator 8 for uniformly charging photosensitive member 7*a*, a charge eliminating lamp 9 for eliminating charge on the non-image region, a developing device 10 for developing the electrostatic latent image formed on photosensitive member 7*a*, a transferring and fixing device 12 for temporarily transferring the visible image on photosensitive member 7*a* to a belt and for further transferring and fixing the same onto a sheet of recording paper, a charge eliminating device 13 for eliminating the electrostatic charge residing on photosensitive member 7*a* after the desired number of copies are obtained, and a cleaning device 14 for removing residual toner on photosensitive member 7*a*.

Developing device 10 incorporates a magnetic sleeve 10*a* adapted to rotate in the reverse direction to rotary drum 7. Transferring and fixing device 12 includes a transferring belt 12*a*, a transferring roller 12*b* for making pressure contact with photosensitive member 7*a* and adapted to transfer the visible image from the latter to transferring belt 12*a*, a tension roller 12*c* for tensioning the belt, and a heating roller 12*d* accommodating an internal heater H. Transferring belt 12*a* encircles rollers 12*b*, 12*c*, 12*d* and an idle roller 12*e*. A pressure roller 15 is maintained in pressure contact with heating roller 12*d* to enable transferring and fixing to be achieved between these rollers.

A paper feeding cassette 16 accommodates sheets of recording paper P which are individually fed therefrom by operation of a paper feeding roller 17 and paper registration rollers 18. After transfer and fixing of the visible image on the recording paper in transferring and fixing device 12, the sheets are successively ejected by paper ejecting rollers 19 and stacked in a paper ejecting tray 20 disposed at the exterior of the reproducing apparatus.

In an electrostatic reproducing apparatus having the foregoing construction, a surface potential meter 21 for detecting the surface potential of the non-image region is disposed in close proximity to the surface of photosensitive member 7*a* substantially midway between its peripheral edges. Surface potential meter 21 is preferably located between the exposure slit 6 and the developing device 10.

Figure 4:
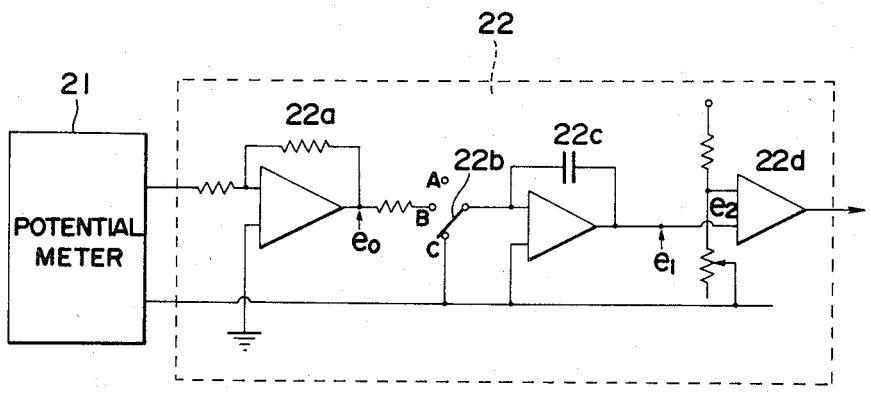
FIG. 4 is a block diagram of an illustrative control circuit incorporated in an apparatus operable in accordance with the invention.

The surface potential signal detected by potential meter 21 is converted to a retention instruction signal by a control circuit 22, a typical example of which is shown in FIG. 4.

As will be understood from FIG. 4, control circuit 22 includes an amplification circuit 22*a* for amplifying the potential signal derived from surface potential meter 21, a change-over switch 22*b* for switching the output of amplification circuit 22*a* to an analog integrating circuit 22*c*, and a comparator circuit 22*d* adapted for comparing the output of integrating circuit 22*c* with a reference voltage.

Comparator circuit 22*d* generates the aforementioned retention instruction signal.

In operation, when a copying button is depressed after positioning a document M on document glass plate 1, rotary drum 7 starts to rotate and, at the same time, charge generator 8 and charge eliminating device 13 are energized. Then, after a predetermined delay, document glass plate 1 starts to move. Since the reference density pattern—i.e. patch D—is formed at the front or leading portion of document glass plate 1, patch D is illuminated by lamp 2 and the light reflected therefrom is applied to photosensitive member 7*a* via first mirror 3, lens 4, second mirror 5 and exposure slit 6. The surface of photosensitive member 7*a* has been uniformly charged, and the charge is extinguished only at those regions to which the reflected light is applied, so that the electrostatic latent image of patch D is formed on the non-image region of photosensitive member 7*a*. As rotary drum 7 further rotates, the electrostatic image of the patch moves beneath surface potential meter 21 to permit the latter to detect its surface potential. Potential meter 21 starts to operate at a certain time following depression of the copy button and operates for a predetermined duration thereafter. The surface potential detection signal is then transmitted to control circuit 22 (FIG. 4) for comparison with a reference voltage $e_2$.

In the meantime, and subsequent to formation of the electrostatic latent image of patch D, an electrostatic latent image of document M is formed on the image region of photosensitive member 7*a*.

The electrostatic latent image of the patch and the electrostatic latent image of the document are both developed and rendered visible by developing device 10. However, transfer of the visual image of the patch to belt 12*a* is prevented by temporarily prohibiting contact of transfer roller 12*b* with photosensitive member 7*a*, while the visual image of document M is transferred to transfer belt 12*a* through contact of roller 12*b* with photosensitive member 7*a*.

Transfer and fixing of the image is effected between heating roller 12*d* and pressure roller 15 on the recording paper which has been fed therebetween by means of paper feeding roller 17 and paper registration roller 18.

Paper feeding roller 17 starts to operate after the completion of operation of surface potential meter 21 and is rotationally driven for a time T thereafter. Paper registration roller 18, on the other hand, starts to operate a predetermined time following the completion of operation of paper feeding roller 17 and continues to operate for a time determined by the maximum size of the recording paper.

The visible image of the patch remains on photosensitive member 7*a*. After transfer of the visual image of the document from photosensitive member 7*a* to transfer belt 12*a*, the visible (toner) image of the patch on member 7*a* and the residual toner of the document image remaining on member 7*a* are removed by means of cleaning device 14.

Document glass plate 1 travels a distance corresponding to the length of document M to form an electrostatic latent image of document M on photosensitive member 7*a*, and is reversed for return travel operation of a microswitch or the like to complete one cycle of copying operation.

When a plurality of copies are to be obtained from a single electrostatic latent image, the apparatus operates in the manner hereafter explained and in accordance with control circuit 22.

It is assumed here that N sheets or copies are to be obtained. The recording cycle explained above is performed for the first copy. After the visible image of the patch has passed the transfer position without making contact with transfer belt 12*a* and before it passes charge eliminating device 13, the latter is rendered inoperative to prevent elimination of and damage to the visible image of the patch. Thereafter, the visible image of the patch and the residual toner of the document image—both on photosensitive member 7*a*—are removed by cleaning device 14.

When the electrostatic image of the patch on member 7*a* is about to pass charge generator 8 after substantially a full rotation of rotary drum 7, charge generator 8 and charge eliminating lamp 9 are placed in their inoperative states. Photosensitive member 7*a* can therefore retain the electrostatic latent image of the patch and the electrostatic latent image of document M. Moreover, the second and subsequent copies can be formed by repeating the operation of only developing device 10, belt-type transferring and fixing device 12 and cleaning device 14, such that one sheet or copy is obtained for each rotation of rotary drum 7.

The surface potential of the electrostatic latent image of the patch is detected by surface potential meter 21 which produces a surface potential detection signal. This signal is transmitted to control circuit 22 (FIG. 4) and, after amplification by amplifier circuit 22*a*, is selected by change-over switch 22*b* and integrated by analog integration circuit 22*c*. Change-over switch 22*b* selects the input to be applied to analog integration circuit 22*c* between a hold terminal A, a set terminal B and a reset terminal C. Preferably, this switch is so arranged as to electrically detect the rotation angle of the rotary drum and to operatively switch between its various positions when predetermined rotation angles of the drum are reached.

Change-over switch 22*b* is connected to set terminal B to connect the output from surface potential meter 21 to analog integration circuit 22*c*, the output of which is then compared with reference voltage $e_2$ in comparator circuit 22*d*. When the surface potential signal derived from potential meter 21 is less than reference voltage $e_2$, charge eliminating device 13 is operated to eliminate the electrostatic image of the document and cleaning device 14 is then energized to remove the visible image of the patch and the residual toner of the document. Finally, after lapse of a time sufficient to enable the rear end of the image forming portion of photosensitive member 7*a* to pass by exposure slit 6, charge generator 8 is actuated and, after a predetermined delay, the recording cycle starts again; i.e. movement of document glass plate 1 and rotation of rotary drum 7 are initiated so that an electrostatic latent image of patch D is again formed on photosensitive member 7*a* followed by formation of a new electrostatic latent image of document M.

The charge generator 8 is maintained in its operating state for a time corresponding to the period of one rotation of the rotary drum (or a time approximating this period), and is then immediately deactivated. Charge eliminating device 13 is likewise maintained in its operating state for a time corresponding to or approximating the period of rotation of the drum and is then immediately deactivated.

The reformed electrostatic latent image of the document is maintained, after its development, until N sheets or copies are obtained by repeated transfer and fixing operations. During this period, the surface potential of the electrostatic latent image of the patch is detected by the surface potential meter at each rotation of the rotary drum and is compared with the reference potential. As the number of copies obtained reaches the preset number N, charge eliminating device 13 starts to operate and is maintained in its operative state until rotary drum 7 completes one further rotation. Operation of the entire apparatus is then stopped after confirmation that the recording paper has passed through a recording paper passage detection device disposed in the vicinity of the paper ejecting opening.

Figure 5:
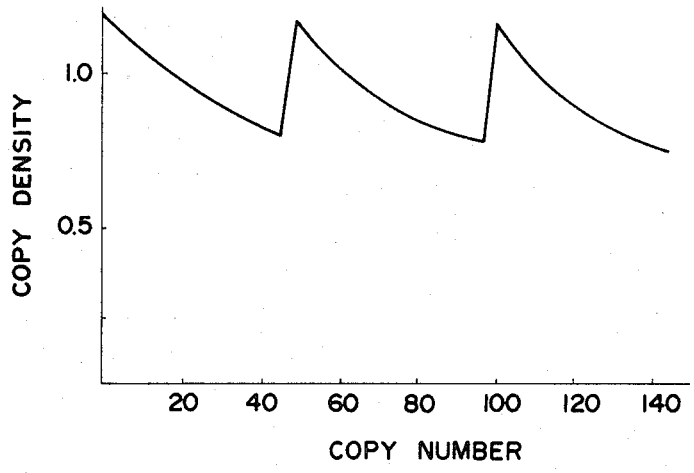
FIG. 5 is a graphical representation of the relationship between the change in surface potential of a patch electrostatic latent image and the number of copies produced.

FIG. 5 graphically shows how the surface potential of the electrostatic latent image of the patch varies in relation to the number of identical sheets or copies obtained from a single document.

Figure 6:
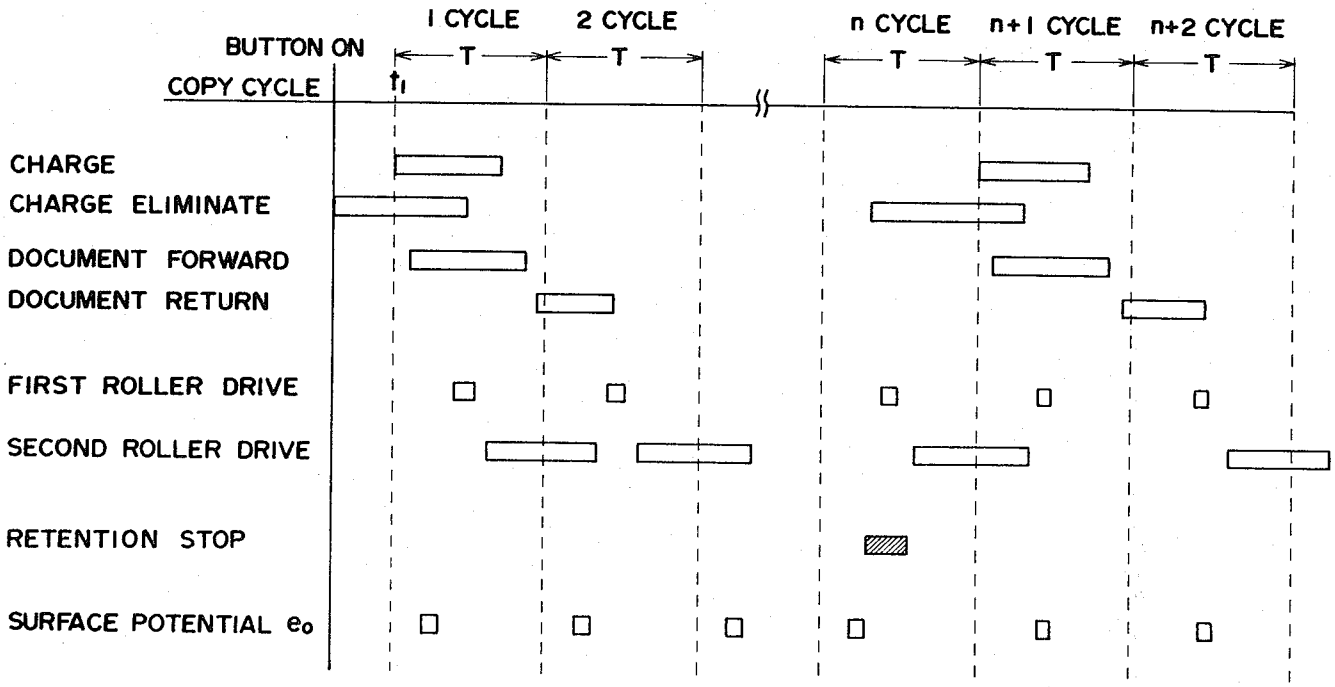
FIG. 6 is a timing chart showing the timing of the various operations of an electrostatic reproducing apparatus operable in accordance with the invention.

FIG. 6 is a timing chart of the constituent elements of an electrostatic reproducing apparatus operating in accordance with the invention. It is assumed that the surface potential of the electrostatic latent image of the patch has dropped below the reference potential when the number of the produced copy sheets has reached "n", while the apparatus is operating to produce "N" ($n<N$) sheets or copies.

Rotary drum 7 starts to rotate as the copying button is depressed and, at the same time, the developing device and the belt transferring and fixing device are put into operation. Charge generator 8 and charge eliminating device 13 are also placed in operative condition. At a time $t_1$ following depression of the copying button, document glass plate 1 starts to move and illumination lamp 2 is turned on for forming an electrostatic latent image of patch D on photosensitive member 7*a*. Then, as the leading edge of the electrostatic latent image of patch D reaches surface potential meter 21, the latter begins to output surface potential detection signal $e_0$ and continues to do so for a predetermined length of time. Surface potential detection signal $e_0$ is delivered to control circuit 22 and is integrated and held as a voltage $e_1$. This voltage $e_1$ is compared in comparator circuit 22*d* with predetermined reference voltage $e_2$. Just before the leading edge of the electrostatic latent image of the document (which is formed immediately after formation of the image of the patch) reaches charge eliminating device 13, the latter is rendered inoperative so as to avoid elimination of the electrostatic image. Charge generator 8 is thereafter similarly rendered inoperative before it is reached by the leading edge of the electrostatic latent image of the document as rotation of the drum 7 continues.

In the meantime, a sheet of recording paper P is fed from cassette 16 to a predetermined stand-by position by means of paper feeding roller 17 which is energized in synchronized timing with formation of the electrostatic image. Then, after lapse of a predetermined time, paper registration roller 18 is energized and maintained in its energized state for the time required to feed the recording paper P; paper registration roller 18 is then stopped. When the period of rotation of rotary drum 7 is represented by T, a counter counts "1" after lapse of a time $t_1+T$. At this moment, the surface potential detection signal stored in control circuit 22 is erased as the switched input terminal of analog integrating circuit 22*c* is converted to position C by action of change-over switch 22*b*.

During production of multiple copies of a single original document, the surface potential of the electrostatic latent image of the patch is detected repeatedly at moments represented by $t_1+n\ T$, the detected output is integrated by the analog integrating device, and the integrated value $e_0$ is compared with the reference value $e_2$. The copying operation is repeated as long as the condition of $e_0>e_2$ is met. Assuming here that the integrated value $e_0$ has dropped below reference value $e_2$ in the $n^{th}$ cycle of copying operations, a retention signal is generated and charge eliminating device 13 is actuated to erase the electrostatic latent image on photosensitive member 7*a*. Thereafter, charge generator 8 is started and illuminating lamp 2 is turned on, while the document glass plate starts to move to reform the electrostatic latent image of the patch on photosensitive member 7*a* together with an electrostatic latent image of the document. The charge eliminating device and the charge generator are then turned off and the entire series of operations including development, transfer and fixing is repeated. The operation of the overall apparatus is stopped when the desired N sheets or copies have been obtained.

As has been described, in accordance with the invention, an electrostatic latent image of a reference density pattern, or patch, is formed on the charge receptor together with an electrostatic latent image of the document. The surface potential of the electrostatic image of the patch is then detected and compared with a reference potential during each copying operation cycle. When the detected surface potential has dropped below a predetermined reference potential, the electrostatic latent image of the document—which has been carried by the charge receptor—is completely eliminated and a new electrostatic image of the document is again formed on the charge receptor.

The present invention accordingly enables the formation of a large number of sheets of identical copies, without substantial degradation of copy quality, irrespective of the performance of the charge receptor and charge leakage through the toner or the charge receptor itself.

We claim:

1. In a method for producing multiple copies of an original in a retention-type reproducing apparatus which includes a charge receptor, comprising the steps of: forming an electrostatic latent image of the original and an electrostatic latent image of a reference patch on said charge receptor, developing said latent images to corresponding toner images thereof; transferring said toner images of said original onto a transferring member; cleaning a surface of said charge receptor of developer remaining thereon; the improvement which comprises the steps of: detecting the surface potential of the electrostatic latent image of said patch, comparing said surface potential a reference value, and providing one of the following steps as a next step for a further copying: (a) developing the existing latent image on said charge receptor without forming a new latent image if said detected surface potential of said electrostatic latent image of said patch is more than said reference value; and (b) reforming the electrostatic latent images of said original and said patch on the charge receptor after eliminating the existing latent image in case that said detected potential of said electrostatic latent image of said patch is less than the reference value.

2. A method in accordance with claim 1, said imaging of the original and the reference patch resulting in the production on the charge receptor of an electrostatic image of the patch at a position upstream of the electrostatic image of the original.

3. A method in accordance with claim 1, said comparison of the measured potential of the electrostatic image of the patch with a reference value further comprising detecting the patch image potential, amplifying the detected potential of the patch image, applying the amplified potential to an integrator, and comparing the output of the integrator with a predetermined reference voltage.

4. The method of claim 1 wherein said transferring member is an intermediate transfer body comprising a silicon elastomer.

* * * * *